US008194898B2

(12) United States Patent
Yokota

(10) Patent No.: US 8,194,898 B2
(45) Date of Patent: Jun. 5, 2012

(54) SOUND REPRODUCING SYSTEM AND SOUND REPRODUCING METHOD

(75) Inventor: Teppei Yokota, Chiba (JP)

(73) Assignee: Sony Corporation, Tokyo (JP)

( * ) Notice: Subject to any disclaimer, the term of this patent is extended or adjusted under 35 U.S.C. 154(b) by 1237 days.

(21) Appl. No.: 11/903,186

(22) Filed: Sep. 20, 2007

(65) Prior Publication Data

US 2008/0187156 A1 Aug. 7, 2008

(30) Foreign Application Priority Data

Sep. 22, 2006 (JP) ..... 2006-256803

(51) Int. Cl.
*H04R 5/02* (2006.01)

(52) U.S. Cl. ..... 381/310; 381/307; 381/107

(58) Field of Classification Search ..... 381/107, 381/108, 307, 310
See application file for complete search history.

(56) References Cited

U.S. PATENT DOCUMENTS

| | | | | |
|---|---|---|---|---|
| 3,115,947 | A | 12/1963 | Wood | |
| 3,824,343 | A | 7/1974 | Dahlquist | |
| 3,870,834 | A | 3/1975 | Yeaple | |
| 5,282,251 | A | 1/1994 | Petersen | |
| 5,610,986 | A * | 3/1997 | Miles | 381/27 |
| 5,680,465 | A | 10/1997 | Boyden | |
| 6,026,168 | A * | 2/2000 | Li et al. | 381/28 |
| 6,195,435 | B1 * | 2/2001 | Kitamura | 381/18 |
| 6,222,930 | B1 | 4/2001 | Nakano et al. | |
| 7,336,792 | B2 | 2/2008 | Sasaki | |
| 7,424,117 | B2 * | 9/2008 | Herberger et al. | 381/61 |
| 2002/0076066 | A1 * | 6/2002 | Yabe et al. | 381/104 |
| 2003/0099369 | A1 | 5/2003 | Cheng | |
| 2003/0103634 | A1 * | 6/2003 | Ito | 381/86 |
| 2003/0103636 | A1 | 6/2003 | Arai et al. | |
| 2004/0013278 | A1 * | 1/2004 | Yamada | 381/309 |
| 2004/0062402 | A1 * | 4/2004 | Fujita et al. | 381/18 |
| 2004/0096065 | A1 * | 5/2004 | Vaudrey et al. | 381/22 |
| 2004/0202332 | A1 * | 10/2004 | Murohashi et al. | 381/17 |
| 2004/0264717 | A1 * | 12/2004 | Fujita et al. | 381/307 |
| 2006/0262936 | A1 * | 11/2006 | Sato | 381/22 |
| 2007/0014417 | A1 * | 1/2007 | Fujita et al. | 381/17 |
| 2007/0127733 | A1 * | 6/2007 | Henn et al. | 381/80 |
| 2007/0183617 | A1 | 8/2007 | Yokota et al. | |
| 2007/0195964 | A1 | 8/2007 | Yokota | |

(Continued)

FOREIGN PATENT DOCUMENTS

CN 1419796 A 5/2003

(Continued)

*Primary Examiner* — David S. Warren
(74) *Attorney, Agent, or Firm* — Wolf, Greenfield & Sacks, P.C.

(57) ABSTRACT

A sound reproducing system includes a first speaker that is supplied with audio signals of a first channel and that is placed so that a reproduced sound image generated by the audio signals of the first channel is localized in a position in a front direction of a listener; a pair of second speakers that are supplied with audio signals on which a virtual sound source process is performed; a virtual sound source processing unit to perform the virtual sound source process on the audio signals of a plurality of channels; a volume detecting unit to detect the volumes of the first channel and the other channels; a volume comparing unit to compare the volume of the first channel with each of the volumes of the other channels; and a control unit to control the gains of the audio signals of the first channel and the other channels.

12 Claims, 12 Drawing Sheets

U.S. PATENT DOCUMENTS

| | | | | |
|---|---|---|---|---|
| 2008/0187156 | A1* | 8/2008 | Yokota | 381/307 |
| 2008/0292121 | A1 | 11/2008 | Yokota | |
| 2008/0298611 | A1* | 12/2008 | Nakamura | 381/307 |
| 2009/0123007 | A1* | 5/2009 | Katayama | 381/300 |
| 2009/0279840 | A1* | 11/2009 | Kudo et al. | 386/52 |
| 2011/0069841 | A1* | 3/2011 | Angeloff et al. | 381/17 |
| 2011/0075848 | A1* | 3/2011 | Purnhagen et al. | 381/2 |
| 2011/0112664 | A1* | 5/2011 | Ong | 700/94 |

FOREIGN PATENT DOCUMENTS

| | | | |
|---|---|---|---|
| EP | 1137319 | A3 | 7/2003 |
| EP | 1439509 | A3 | 7/2004 |
| FR | 2859863 | | 3/2005 |
| GB | 2426169 | A | 5/2005 |
| JP | 03-069466 | U | 7/1991 |
| JP | 03-235498 | A | 10/1991 |
| JP | 05-022798 | A | 1/1993 |
| JP | 05-095591 | | 4/1993 |
| JP | 05-191342 | A | 7/1993 |
| JP | 08-047080 | A | 2/1996 |
| JP | 08-123433 | A | 5/1996 |
| JP | 09-284883 | | 10/1997 |
| JP | 09-327099 | | 12/1997 |
| JP | 10-014000 | A | 1/1998 |
| JP | 10-224900 | | 8/1998 |
| JP | 10-243500 | A | 9/1998 |
| JP | 11-501479 | A | 2/1999 |
| JP | 2001-078288 | A | 3/2001 |
| JP | 2001-268700 | A | 9/2001 |
| JP | 2002-269916 | A | 9/2002 |
| JP | 2002-291100 | A | 10/2002 |
| JP | 2003-061198 | A | 2/2003 |
| JP | 2003-070099 | A | 3/2003 |
| JP | 2003-084790 | A | 3/2003 |
| JP | 2004-072564 | A | 3/2004 |
| JP | 2004-135023 | A | 4/2004 |
| JP | 2004-187300 | A | 7/2004 |
| JP | 2004-266692 | A | 9/2004 |
| JP | 2004-289762 | A | 10/2004 |
| JP | 2004-357075 | A | 12/2004 |
| JP | 2005-045533 | A | 2/2005 |
| JP | 2005-280580 | A | 10/2005 |
| JP | 2005-303707 | A | 10/2005 |
| JP | 2006-245477 | A | 9/2006 |
| JP | 2006-345477 | A | 12/2006 |
| JP | 2006-345480 | A | 12/2006 |
| JP | 2007-001507 | A | 1/2007 |
| JP | 2007-195092 | A | 8/2007 |
| WO | WO 2006/109389 | A1 | 10/2006 |

* cited by examiner 300
301
5.1-CH DECODER
L
C
R
RL
RR
LFE
G1
G2
G3
G4
G5
G6
FRONT HRTF CONVOLVING CIRCUIT
REAR HRTF CONVOLVING CIRCUIT
DL
I/O
VOLUME DETECTING UNIT
FRONT HRTF STORING UNIT
REAR HRTF STORING UNIT
GAIN CONTROL SIGNAL GENERATING UNIT
VOLUME COMPARING UNIT
USER I/F
RAM
ROM
CPU
100

FIG. 10A

| No. | FRONT | CENTER | REAR |
|---|---|---|---|
| 1 | s | s | s |
| 2 | s | s | m |
| 3 | s | s | l |
| 4 | s | m | s |
| 5 | s | m | m |
| 6 | s | m | l |
| 7 | s | l | s |
| 8 | s | l | s |
| 9 | s | l | l |
| 10 | m | s | s |
| 11 | m | s | m |
| 12 | m | s | l |
| 13 | m | m | s |
| 14 | m | m | m |
| 15 | m | m | l |
| 16 | m | l | s |
| 17 | m | l | m |
| 18 | m | l | l |
| 19 | m | s | s |
| 20 | l | s | m |
| 21 | l | s | m |
| 22 | l | m | s |
| 23 | l | m | m |
| 24 | l | m | l |
| 25 | l | l | s |
| 26 | l | l | m |
| 27 | l | l | l |

FIG. 10B

| CENTER |
|---|
| |
| |
| |
| m |
| m |
| l |
| l |
| l |
| |
| |
| |
| m |
| m |
| |
| l |
| l |
| |
| |
| |
| |
| |
| l |
| l |
| l |

FIG. 10C

| FULL AT THE EARS | WITHOUT C AT THE EARS |
|---|---|
| s | |
| m | |
| l | |
| | s |
| | m |
| l | |
| | s |
| | m |
| | l |
| s | |
| m | |
| l | |
| | m |
| | m |
| l | |
| | m |
| | m |
| | l |
| l | |
| l | |
| l | |
| l | |
| l | |
| l | |
| | l |
| | l |
| | l |

FIG. 10C

SOUND REPRODUCING SYSTEM AND SOUND REPRODUCING METHOD

CROSS REFERENCES TO RELATED APPLICATIONS

The present invention contains subject matter related to Japanese Patent Application JP 2006-256803 filed in the Japanese Patent Office on Sep. 22, 2006, the entire contents of which are incorporated herein by reference.

BACKGROUND OF THE INVENTION

1. Field of the Invention

The present invention relates to a sound reproducing system to reproduce sound by performing a virtual sound source process on audio signals of part of a plurality of channels. The present invention also relates to a sound reproducing method in the sound reproducing system.

2. Description of the Related Art

A video and sound reproducing system called a "home theater system" has been becoming widespread. In the video and sound reproducing system, video is reproduced from a DVD (digital versatile disc) or the like by displaying it on a display having a relatively large screen, while sound is reproduced in a multi-channel surround sound method, recently in a 5.1 channel method. Accordingly, the video and sound can be powerfully reproduced.

In a sound reproducing system of the 5.1 channel method, four types of speakers are used: one located in front of a listener (hereinafter referred to as "front"); one located at the center in front of the listener (hereinafter referred to as "center"); one located at the rear of the listener (hereinafter referred to as "rear"); and one dedicated to low frequencies. A sub-woofer, which is a speaker dedicated to low frequencies, originally handles a frequency band of 100 Hz or less in monaural. The other speakers handle 100 Hz to 20 KHz.

FIG. 13 illustrates placement of speakers in a conventional sound reproducing system of the 5.1 channel method. That is, as illustrated in FIG. 13, a speaker 10FL for a front-left channel is placed on the left in front of a listener 4, a speaker 10FR for a front-right channel is placed on the right in front of the listener 4, and a speaker 10C for a center channel is placed at the center in front of the listener 4.

Also, a speaker 10RL for a rear-left channel is placed on the left at the rear of the listener 4 and a speaker 10RR for a rear-right channel is placed on the right at the rear of the listener 4. Furthermore, a sub-woofer speaker 10SW for a LFE (low frequency effect) channel (dedicated to low frequencies) is placed at an appropriate position.

These six speakers 10FL, 10FR, 10C, 10RL, 10RR, and 10SW are attached to speaker boxes, respectively, and are positioned at respective positions. Typically, the six speakers on the front and rear sides are placed such that a distance ds from the listener 4 is about two meters, for example.

In the conventional sound reproducing system, speaker boxes of about 15 litters used in the speakers for front-left and front-right channels have been replaced by small boxes of around one litter, and such speakers are called satellite speakers. Of course, those speakers do not output sound of low frequencies, and thus a speaker dedicated to low frequencies called a sub-woofer is added to the system. As in this case, when the speakers other than the sub-woofer are small boxes, the crossover frequency of audio signals supplied to the sub-woofer 10SW is 150 Hz, slightly higher than the above-mentioned 100 Hz, but this frequency is still low.

When audio signals of the 5.1 channel from a DVD are reproduced in the speaker system of the above-described placement, sufficient bass sound can be reproduced as a matter of course. Furthermore, a channel dedicated to low frequencies is provided on a reproducing side. Thus, when the sound source is a movie, deep bass sound that could not have been conventionally obtained echoes throughout a room, and powerful and realistic sensation can be obtained.

However, in a relatively small room, it may be impossible to make room for placing the above-described six speakers to reproduce multi-channel surround sound. Also, the necessity for six speakers and amplifiers leads to high cost disadvantageously.

Noise caused by sound leakage is also a problem. For example, volume of about 90 dB or more is required to reproduce powerful sound in video and sound appreciation of a DVD in a typical 5.1-channel speaker configuration. That is, if a listener wants to obtain a favorable effect of the multi-channel surround, he/she needs to consider a noise problem.

An example of a method for solving the above-described problems is a virtual sound source process (virtual sound image localization process) described in Patent Documents 1 and 2 (Japanese Unexamined Patent Application Publications Nos. 9-327099 and 10-224900).

In this process, audio signals to be supplied to two actually-placed speakers are generated. The audio signals are processed based on a transfer function (HRTF: head-related transfer function) to both ears of a listener when speakers are placed in positions where a virtual sound image is localized.

By using this virtual sound source process, the above-described multi-channel surround sound of the 5.1 channel can be reproduced with only two speakers. Accordingly, the space can be saved and the cost can be reduced.

SUMMARY OF THE INVENTION

The applicant of the present application has provided a sound reproducing system capable of realizing multi-channel surround sound by using the above-described virtual sound source process in Japanese Patent Application No. 2006-24302 (filed on Feb. 1, 2006).

In this previously suggested invention, two speakers are held near the ears of a listener and thus the listener can listen to sound with a sufficient volume even if the sound is actually output from the speakers in not so large volume. Accordingly, the sound propagated to adjacent houses is reduced.

Furthermore, in the previously suggested invention, sound components of front and rear channels of the multi-channel surround sound are supplied to the two speakers after a virtual sound source process is performed thereon, and those sound components of the front and rear channels are reproduced. With this configuration, there is no need to provide speakers for the front and rear channels advantageously.

In this case, however, the localization of a sound image (virtual sound image) of sound reproduced based on audio signals on which the virtual sound source process is performed is deteriorated in a channel in which a sound image is localized in a position in a plane including a median plane of the listener (that is, the center channel in the 5.1-channel multi-surround method), compared to a case where a real speaker (the term "real speaker" is used to distinguish it from a speaker to reproduce audio signals on which the virtual sound source process is performed) is actually placed for the channel at the sound image localized position of the channel and audio signals of the channel are supplied to the real speaker so as to reproduce sound.

That is, in the sound of the channel having a sound image localized position in a plane including the median plane of the listener, such as the center channel, the localization of a virtual sound image generated by the virtual sound source process deteriorates.

In this case, the real speaker includes not only a speaker for the center channel that is placed at a position where a sound image of the center channel is localized, but also two speakers for two front-left and front-right channels in a case where sound image localization of the center channel is obtained by supplying audio signals of the center channel to the real speakers for the two front left and front-right channels in equal amounts.

The present invention has been made in view of the above-described points and is directed to providing a sound reproducing system solving a problem of deterioration of sound image localization of a channel having a sound image localized position in a plane including a median plane of a listener, such as a center channel in the above-described virtual sound source process.

According to an embodiment of the present invention, there is provided a sound reproducing system to reproduce audio signals of a plurality of channels including a first channel in which a reproduced sound image is localized in a position in a front direction of a listener. The sound reproducing system includes a first speaker that is supplied with audio signals of the first channel and that is placed so that the reproduced sound image generated by the audio signals of the first channel is localized in a position in the front direction of the listener; a pair of second speakers that are supplied with audio signals on which a virtual sound source process is performed so that the reproduced sound image is localized in a predetermined position; virtual sound source processing means for performing the virtual sound source process on the audio signals of the plurality of channels so as to generate audio signals to be supplied to the second speakers; volume detecting means for detecting the volume of the first channel from the audio signals of the first channel and detecting the volumes of the channels other than the first channel from the audio signals of the other channels; volume comparing means for comparing the volume of the first channel with each of the volumes of the other channels detected by the volume detecting means; and control means for controlling the gains of the audio signals of the first channel and the other channels based on a comparison result generated by the volume comparing means.

In the sound reproducing system having the above-described configuration, a real speaker is placed as the first speaker for the first channel in which a reproduced sound image is localized in a position in a front direction of a listener, for example, a center channel, among the plurality of channels. Also, the pair of second speakers supplied with audio signals of the plurality of channels on which the virtual sound source process is performed are provided.

The volume detecting means detects the volume of the first channel and the volumes of the audio signals of the channels other than the first channel. The volume comparing means compares the volume of the first channel with each of the volumes of the other channels detected by the volume detecting means.

The control means controls the gains of the audio signals of the first channel and the other channels based on a comparison result generated by the volume comparing means.

The gain control of the audio signals of the plurality of channels performed by the control means enables improvement in sound image localization of sound of a channel in which a sound image is localized in a position in a front direction of a listener, such as the center channel where the sound image localization is difficult to obtain, even when sound of a plurality of channels is reproduced by using the virtual sound source process.

According to an embodiment of the present invention, sound image localization of sound of a channel in which a sound image is localized in a position in a front direction of a listener, such as a center channel where the sound image localization is difficult to obtain, can be improved even when sound of a plurality of channels is reproduced by using the virtual sound source process.

BRIEF DESCRIPTION OF THE DRAWINGS

FIGS. 10A to 10C are for illustrating gain adjustment performed on audio signals of respective channels in the sound reproducing system according to the embodiment;

DESCRIPTION OF THE PREFERRED EMBODIMENTS

Hereinafter, a sound reproducing system according to an embodiment of the present invention is described with reference to the drawings. In this embodiment, a case of reproducing the above-described multi-channel surround sound of the 5.1 channel method is described as an example.

The embodiment described below is an example of a case where image-viewing and 5.1-channel surround sound-listening are performed by using video signals and audio signals reproduced in a DVD player. In this embodiment, a screen of a television receiver is used for image-viewing, while multi-surround sound of the 5.1 channel is reproduced by using two speakers included in the television receiver and two speakers provided near the ears of a listener.

Figure 1:
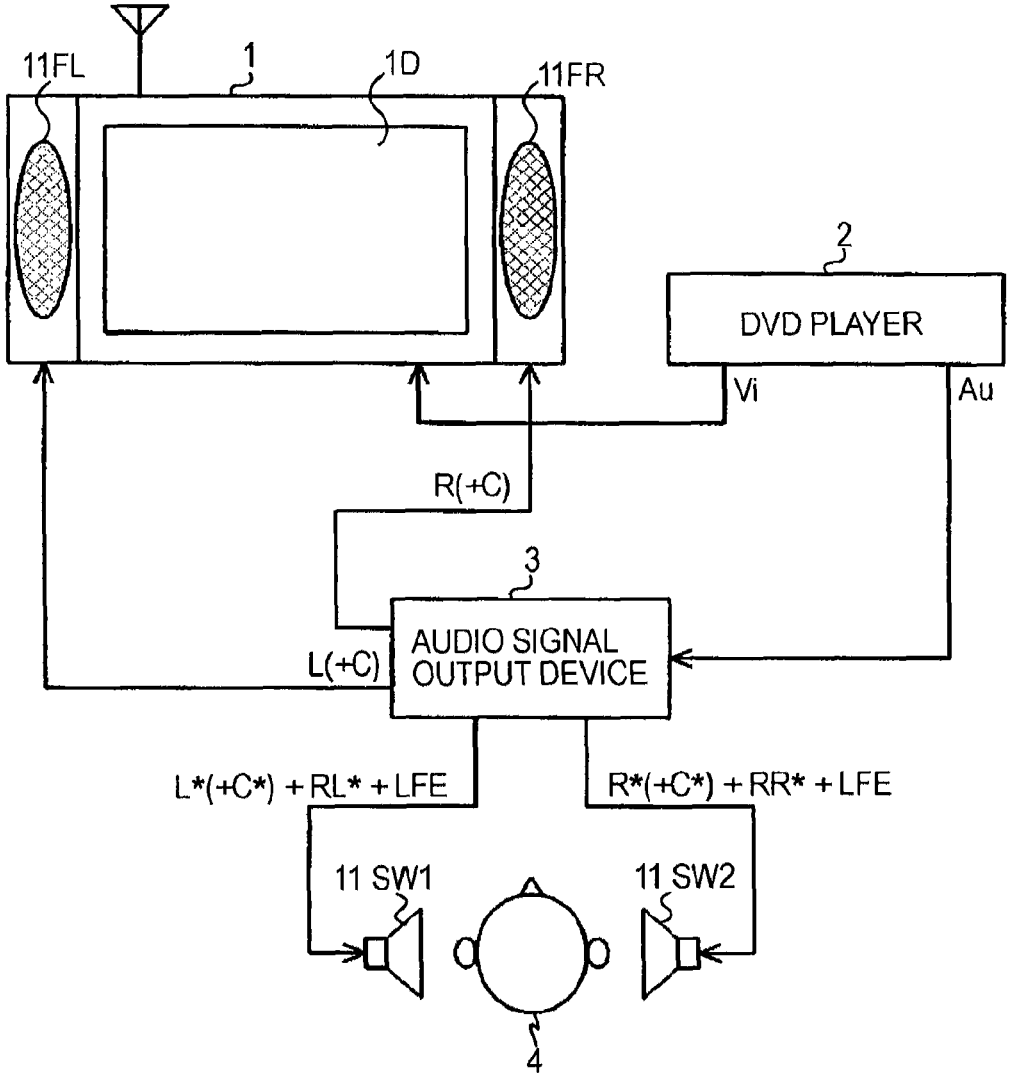
FIG. 1 illustrates an example of a configuration of a sound reproducing system according to an embodiment of the present invention.

FIG. 1 illustrates an overview of the sound reproducing system according to this embodiment.

As illustrated in FIG. 1, the sound reproducing system according to this embodiment includes a television receiver 1 including two speakers 11FL and 11FR for two front-left and front-right channels; a DVD player 2; an audio signal output device 3; and two speakers 11SW1 and 11SW2 provided near the ears of a listener 4.

Basically, in this embodiment, a virtual sound source process is performed on audio signals of all channels, except a LFE (low frequency effect) channel, of the 5.1 channel surround method, and sound is reproduced by using the two speakers 11SW1 and 11SW2 provided near the ears of the listener 4.

However, as described above in the summary, it is difficult to localize the sound of a channel in which a reproduced sound image is to be localized in a plane including a median plane of the listener 4, in this case the sound of a center channel, as a virtual sound image. For this reason, the sound of the center channel is not only localized as a virtual sound image but also reproduced by using a real speaker in this embodiment.

In this case, a real speaker dedicated to the center channel is not provided, but the two speakers for the front-left and front-right channels (for two-channel stereo) included in the television receiver 1 are used. That is, audio signals of the center channel are added thereto in a ratio of 1:1 so as to realize sound image localization of the sound of the center channel by a real speaker.

The reason for this configuration is as follows. That is, a display is typically placed straight in front of the listener 4 and two real speakers for the front-left and front-right channels are placed on both sides of the display. However, it is rare that the real speaker for the center channel is placed at the center position where the display is placed.

In this embodiment, the virtual sound source process is performed on audio signals of the front-left and front-right channels in the 5.1-channel surround sound, and the sound is reproduced by using the two speakers 11SW1 and 11SW2 near the ears of the listener 4. Also, the two speakers 11FL and 11FR of the television receiver 1 are used as real speakers.

The two speakers 11FL and 11FR of the television receiver 1 may be placed inside the casing of the television receiver 1 or may be provided separately and independently from the television receiver 1.

In this embodiment, the two speakers 11SW1 and 11SW2 provided near the ears of the listener 4 are also supplied with audio signals of a low-frequency channel in the 5.1-channel surround sound. For this reason, speakers capable of adequately reproducing audio signals of the LFE channel are preferably used as the speakers 11SW1 and 11SW2.

The television receiver 1 has a function capable of receiving television broadcast signals, for example. The television receiver 1 reproduces video signals and audio signals of a television broadcast program based on received television broadcast signals, displays reproduced images of the television broadcast program on a display 1D of the television receiver 1, and outputs reproduced sound of the television broadcast program through the speakers 11FL and 11FR.

The DVD player 2 reproduces video signals and audio signals recorded on a DVD and outputs the signals. In this example, video signals Vi reproduced in the DVD player 2 are supplied to the television receiver 1, and images corresponding to the reproduced video signals Vi are displayed on the display 1D. On the other hand, audio signals Au reproduced in the DVD player 2 are supplied to the audio signal output device 3.

In this embodiment, the audio signal output device 3 has a decoding function corresponding to the multi-channel surround sound method of the 5.1 channel. When the sound of a digital broadcast program received by the television receiver 1 is to be reproduced in the 5.1-channel surround sound, the audio signal output device 3 generates audio signals to be supplied to the first and second speakers 11SW1 and 11SW2 provided near the ears of the listener 4 and supplies the generated signals to the corresponding speakers.

When images and sound reproduced by the DVD player 2 are to be displayed and output, the audio signal output device 3 generates not only audio signals to be supplied to the first and second speakers 11SW1 and 11SW2 provided near the ears of the listener 4 but also audio signals to be supplied to the two speakers 11FL and 11FR for the left and right channels of the television receiver 1, and supplies the audio signals to the corresponding speakers.

In this embodiment, the audio signal output device 3 supplies a sum signal (L+C) of an audio signal L of the front-left channel and an audio signal C of the center channel; and a sum signal (R+C) of an audio signal R of the front-right channel and an audio signal C of the center channel to the two speakers 11FL and 11FR for the two left and right channels of the television receiver 1.

Also, the audio signal output device 3 supplies audio signals on which a so-called virtual sound source process is performed to the two speakers 11SW1 and 11SW2 near the ears of the listener 4, as described below.

Example of Placement of Speakers in the Embodiment

Hereinafter, an example of placement of speakers in the sound reproducing system according to this embodiment is described with reference to FIG. 2.

Figure 2:
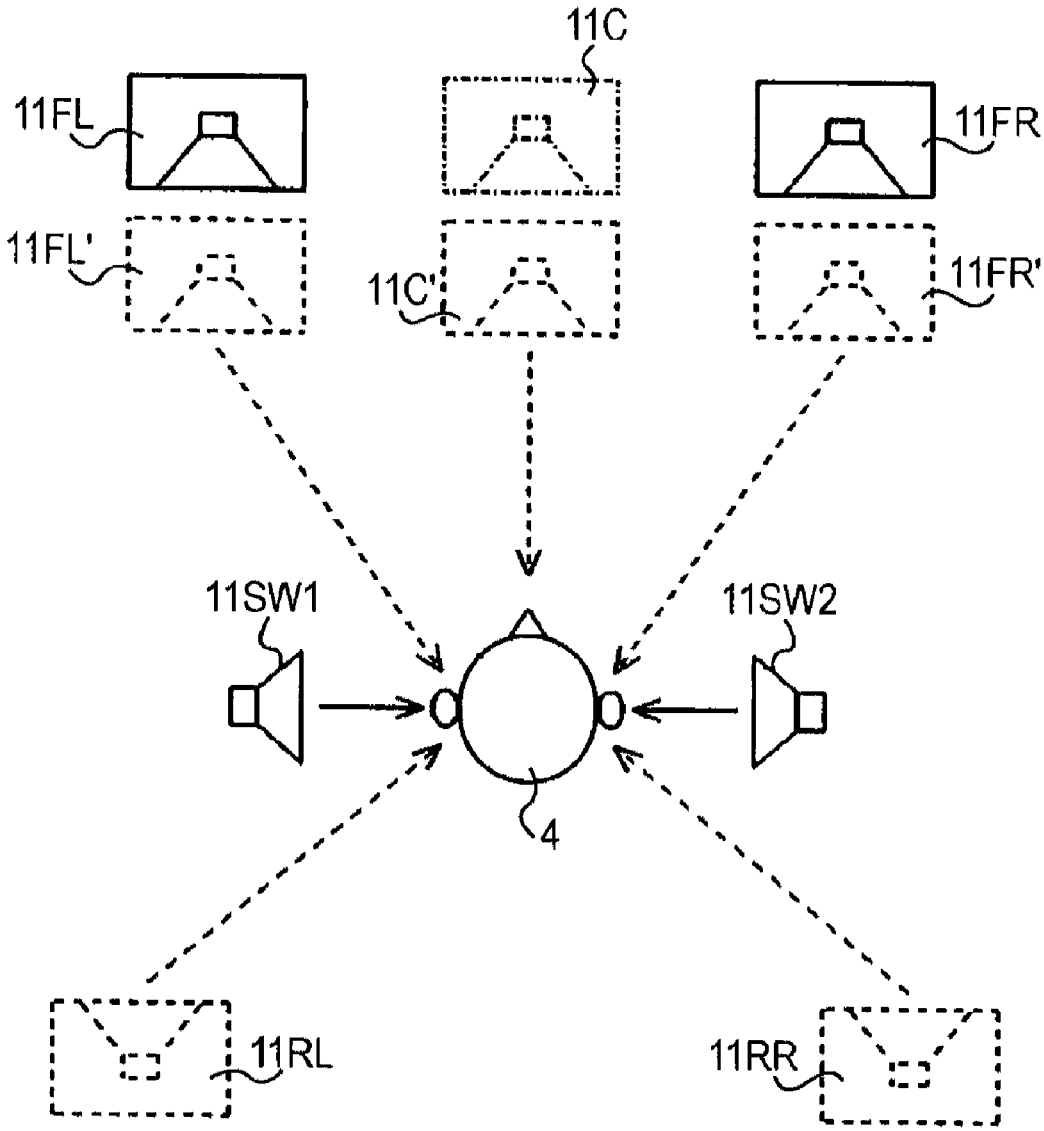
FIG. 2 illustrates an example of placement of speakers in the sound reproducing system according to the embodiment.

Referring to FIG. 2, as indicated by solid lines, the speaker 11FL for the front-left channel and the speaker 11FR for the front-right channel are placed as real speakers on the left and right in front of the listener 4. Also, the two speakers 11SW1 and 11SW2 for virtual sound image localization are placed near the left and right ears of the listener 4 such that vibrating plates of the speakers face the respective ears and that the speakers sandwich the head of the listener 4.

As described above, the speakers 11FL and 11FR in front of the listener 4 are included in the television receiver 1 in this example, and are thus configured as respective speaker units attached to a baffle plate, which is a front side of small speaker boxes 12FL and 12FR (e.g., a front panel of the television receiver). Hereinafter, the speakers 11FL and 11FR are called front speakers when the channels thereof need not be distinguished from each other.

A center speaker 11C is not actually provided as a real speaker in this example. However, as described above, audio signals of the center channel are added to the speakers 11FL and 11FR for the front-left and front-right channels in a ratio of 1:1, so that the sound image of the center channel is localized as in the case where a real speaker is placed at the position of the speaker 11C indicated by a dashed and dotted line in FIG. 2. In this specification, the speaker 11C is called a real speaker.

In the two speakers 11SW1 and 11SW2 placed near the left and right ears of the listener 4 while sandwiching the head of the listener 4, the speaker units are not accommodated in speaker boxes and are not attached to a baffle plate so that the sounds emitted from the front and rear sides of the vibrating plates of the speaker units can be mixed.

In this embodiment, as described above, low-frequency audio signals of the LFE channel are supplied to the two speakers 11SW1 and 11SW2 near the ears of the listener 4, so that low-frequency sound of the LFE channel is emitted in the same phase from those speakers 11SW1 and 11SW2. Therefore, the speakers 11SW1 and 11SW2 serve as a sub-woofer in this embodiment.

Also, in this embodiment, the virtual sound source process is performed on audio signals of all channels, except the LFE channel, of the 5.1 channel, and the audio signals are supplied to the speakers 11SW1 and 11SW2.

With this configuration, low-frequency sound of the LFE channel is emitted near the ears of the listener 4, and thus the listener 4 feels as if he/she listens to the sound of a large volume. However, the low-frequency sound can be hardly listened to at a distance from the listener 4 because the sounds output from the front and rear sides of the vibration plates of the speaker units of the speakers 11SW1 and 11SW2 are 180° out of phase with each other and they cancel each other out. As a result, nuisance to the neighbors caused by low-frequency sound propagated can be prevented.

Figure 3:
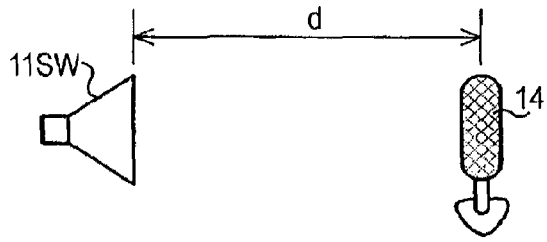
FIG. 3 illustrates an example of placement of speakers in the sound reproducing system according to the embodiment.
Figure 4:
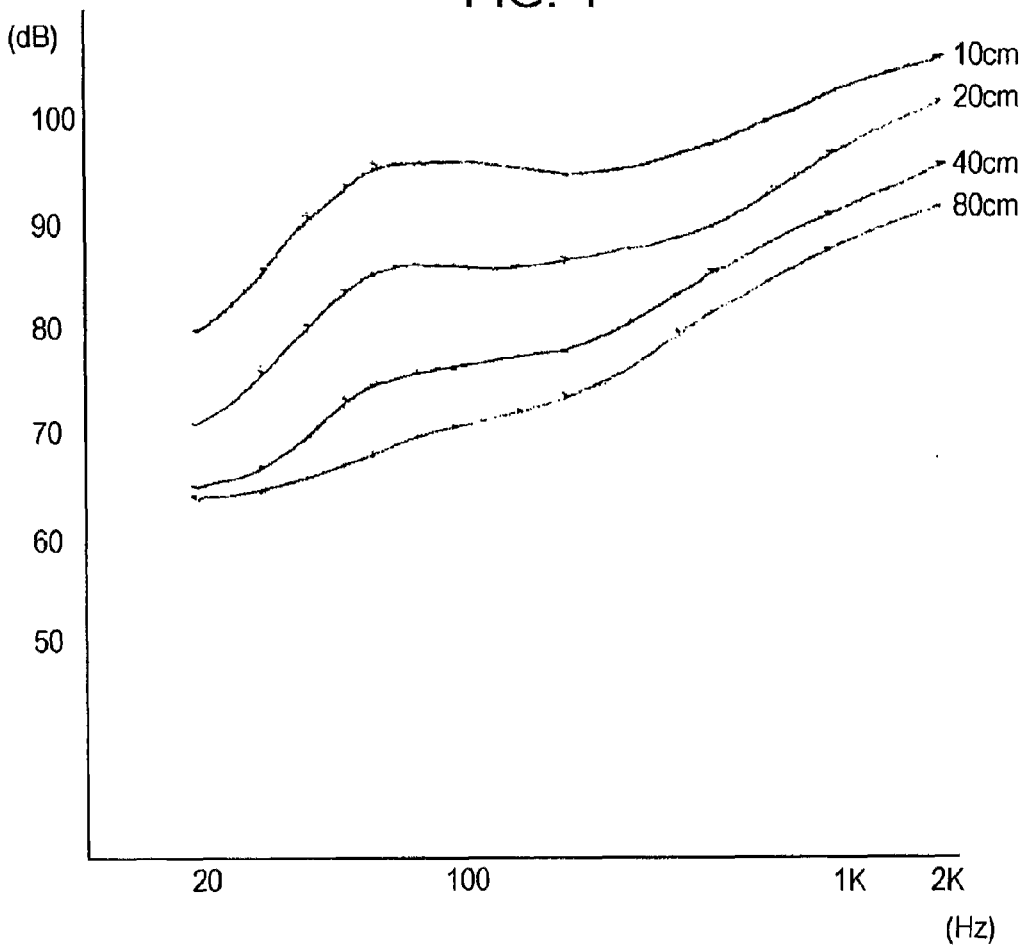
FIG. 4 is for illustrating an operation of the sound reproducing system according to the embodiment, in which the relationship between distances and sound pressures are shown.

In order to verify the attenuation of low-frequency sound, the sound from a speaker unit 11SW, serving as a sub-woofer and having a diameter of 17 cm, was collected by a microphone 14 at a position distant from the speaker unit 11SW by a distance d in an anechoic room, as illustrated in FIG. 3, and frequency characteristics of the sound pressure levels were measured. The results are illustrated in FIG. 4. In this case, the speaker unit 11SW is neither accommodated in a box nor attached to a baffle plate.

As illustrated, the four frequency characteristic curves in FIG. 4 indicate the results obtained when the distance d between the speaker unit 11SW and the microphone 14 is 10 cm, 20 cm, 40 cm, and 80 cm, respectively.

The results illustrated in FIG. 4 verify that the sound of 1 KHz or less is considerably attenuated when the speaker unit is not accommodated in a box. In particular, the attenuation amount is larger as the frequency is lower.

In this embodiment, distances dsw between the two speakers 11SW1 and 11SW2 and the left and right ears of the listener 4 are set so that low-frequency sound is propagated to the ears of the listener 4 with not so being attenuated, in this case, about 20 cm.

For example, the distance between the speaker unit 11SW and the ears of the listener 4 is typically 2 meters in a conventional example. On the other hand, in this embodiment, the distances between the speakers 11SW1 and 11SW2 and the ears of the listener 4 are 20 cm. Thus, the distance according to this embodiment is one tenth of that of the conventional example.

Accordingly, the energy required for the listener 4 to feel the same sound pressure is one hundredth of that in the above-described typical example. Specifically, if an amplifier of 100 W (watt) is required in the above-described typical example, the same sound pressure can be obtained with an amplifier of 1 W in this embodiment.

In this embodiment, the amount of diffused sound is reduced even by a difference in output of audio signals supplied to the speakers. Furthermore, sound of low frequencies, e.g., 20 Hz, 30 Hz, and 40 Hz is canceled in terms of phases and the sound can be hardly listened to in an area except the vicinity of the speaker unit of the sub-woofer. On the other hand, a powerful sound effect included in DVD software can be obtained by giving considerable energy to the low-frequency sound, and thus a soundproof effect enhances.

In the above-described configuration, if attention is paid only on low-frequency sound and if only the low-frequency sound is attenuated, a sufficient effect can be obtained. Of course, the same soundproof effect as that described above can be obtained when the sound other than the low-frequency sound is reproduced and emitted from the speakers 11SW1 and 11SW2.

In this embodiment, the virtual sound source process is performed on audio signals of all channels, except the LFE channel, of the 5.1 channel, and the audio signals are supplied to the speakers 11SW1 and 11SW2.

That is, the 5.1-channel surround sound includes sounds of five channels: front-left and front-right channels; center channel; and rear-left and rear-right channels, in addition to the LFE channel, as illustrated in FIG. 2.

Typically, speakers 11FL', 11FR', and 11C' in which speaker units are attached to the front side of speaker boxes serving as a baffle plate, and speakers 11RL and 11RR are placed on the front side and rear side of the listener 4, as indicated by broken lines in FIG. 2.

In this embodiment, sounds of the respective channels are audio signals on which the virtual sound source process is performed, as described below. The audio signals are supplied to the speakers 11SW1 and 11SW2 facing the ears of the listener 4, so that the sound is reproduced.

In this case, the front-left and front-right channels and the center channel in front of the listener 4 doubly exist: one for reproducing sound by using the real speakers and the other for reproducing sound by using the speakers 11SW1 and 11SW2 placed near the ears of the listener 4 by audio signals on which the virtual sound source process is performed.

In this embodiment, the sound reproducing system is configured in the above-described manner. As described below, audio signals to be supplied to the real speakers and audio signals to be supplied to the speakers 11SW1 and 11SW2 after the virtual sound source process is performed thereon are gain-controlled in accordance with the volume of the audio signals of the center channel, so that the sound image of especially the center channel is localized at the position of the real speaker 11C in FIG. 2. Accordingly, the sound image localization is improved.

As described above, the distances between the speakers 11SW1 and 11SW2 and the ears of the listener 4 are short. Therefore, the radiation energy of audio signals of the LFE channel and the other channels in the corresponding audio frequencies can be reduced to contribute to the soundproof effect.

Also, as described above, the sound pressure of the speakers 11SW1 and 11SW2 can be reduced by 20 dB by setting the distances dsw between the speakers 11SW1 and 11SW2 and the ears of the listener 4 to 20 cm, compared to the typical example where the distance dsw is 2 meters. This can also be applied to the audio signals RL and RR of the rear-left and rear-right channels, so that energy saving can be realized.

An example of placement of the speakers considering the above-described points is a method for setting the speakers on a chair having a configuration of a massage chair or the like.

Figure 5:
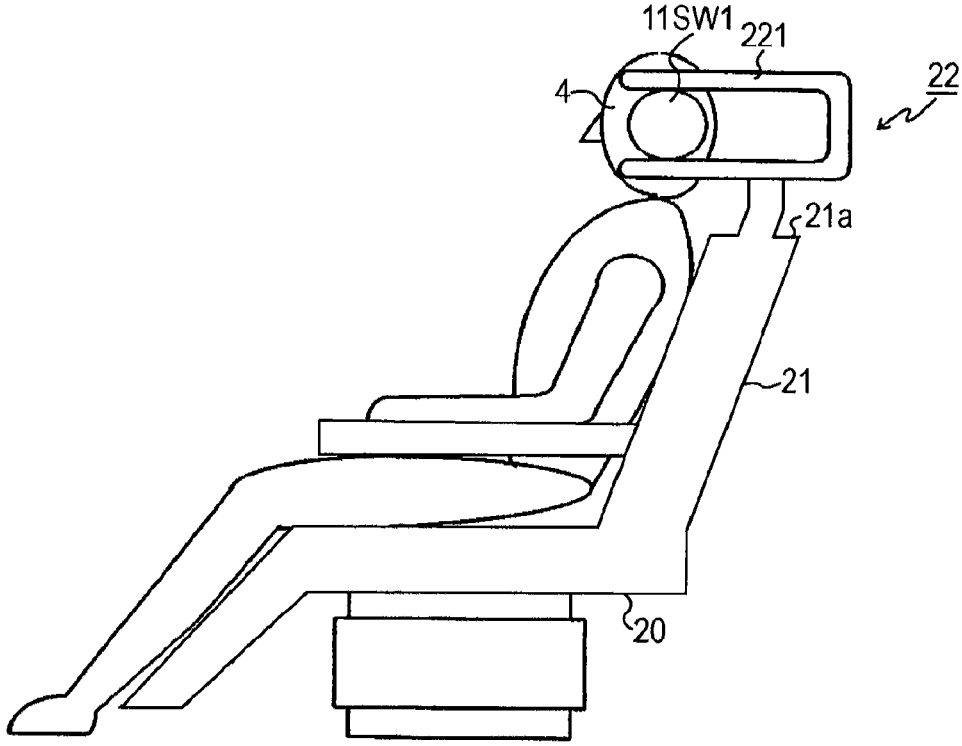
FIG. 5 illustrates an example of placement of speakers in the sound reproducing system according to the embodiment.

FIG. 5 illustrates an example of such a case, where the two speakers 11SW1 and 11SW2 to be placed near the ears of the listener 4 are set on a chair.

That is, in this example, a chair 20 has a structure as that of a seat of a business class of an aircraft. A speaker holder 22 is attached to a top portion 21*a* of a backrest 21 of the chair 20, and the speakers 11SW1 and 11SW2 are attached to and held by the speaker holder 22.

Figure 6A:
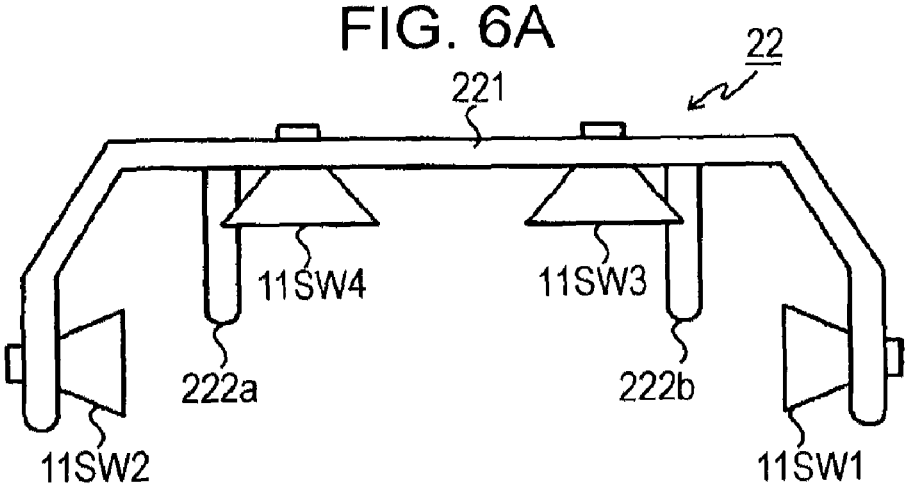
FIGS. 6A and 6B illustrate an example of placement of speakers in the sound reproducing system according to the embodiment.
Figure 6B:
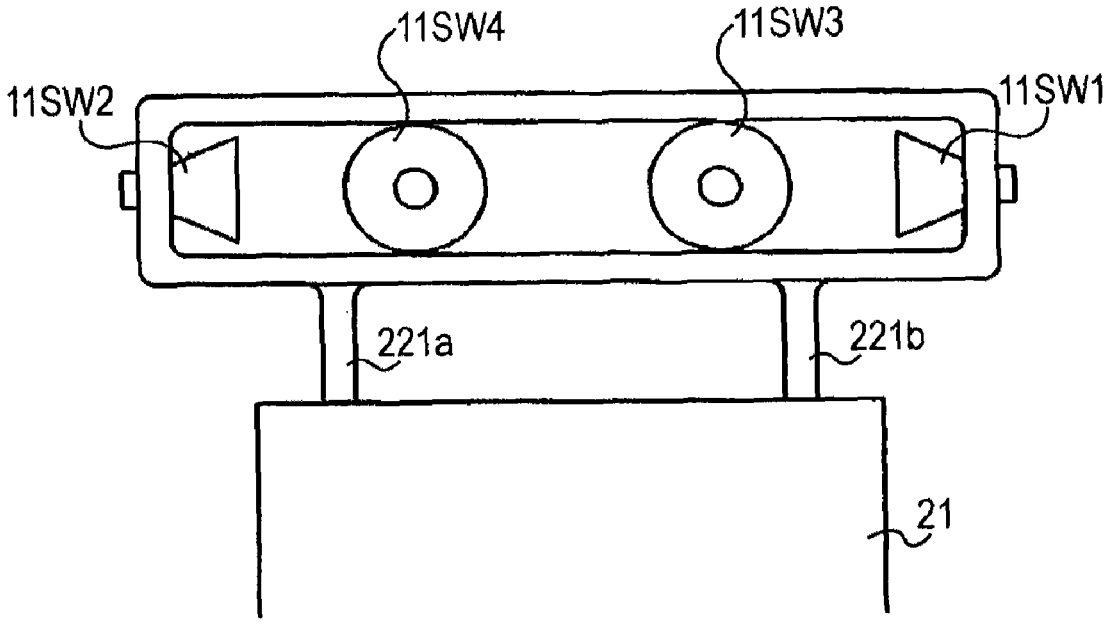

FIGS. 6A and 6B illustrate an example of the speaker holder 22. The speaker holder 22 includes a pipe 221 made of metal, such as aluminum. As illustrated in FIG. 6B, the pipe 221 is flat ring-shaped. In the space defined by the ring, the speakers 11SW1 and 11SW2 and auxiliary speakers 11SW3 and 11SW4 are held while being fixed.

The auxiliary speakers 11SW3 and 11SW4 are provided for complementing the power of low-frequency sound, which may not sufficiently be obtained in terms of audibility only with the speakers 11SW1 and 11SW2 placed near the ears of the listener 4. The auxiliary speakers 11SW3 and 11SW4 are not always necessary.

In this embodiment, only low-frequency audio signals (LFE signals) may be supplied to the auxiliary speakers 11SW3 and 11SW4. Alternatively, audio signals on which the virtual sound source process is performed may be supplied to the auxiliary speakers 11SW3 and 11SW4, as the speakers 11SW1 and 11SW2.

The pipe 221 is flat ring-shaped. As illustrated in FIG. 6A, the ring-shaped portion is substantially U-shaped so as to surround the side portion of the head of the listener 4 except the front side of the face (the sides facing the right and left ears) and the rear portion of the head.

Also, leg portions 222*a* and 222*b* connect to the ring-shaped pipe 221, which are used to attach the speaker holder 22 to the backrest 21 of the chair 20. By using the leg portions 222*a* and 222*b*, the speaker holder 22 can be detachably provided on the backrest 21 of the chair 20. More specifically, long holes (not shown) to which the leg portions 222*a* and 222*b* are to be inserted and fitted are provided in the top portion 21*a* of the backrest 21 of the chair 20. By inserting and fitting the leg portions 222*a* and 222*b* to the long holes in the backrest 21, the speaker holder 22 is fixed to the chair 20.

The speakers 11SW1 and 11SW2 are fixed to and held by the U-shaped pipe 221 at the positions facing the ears of the listener 4 sitting on the chair 20. Also, the auxiliary speakers 11SW3 and 11SW4 are fixed to and held by the pipe 221 at the rear of the head of the listener 4.

In this example, the distances between the speakers 11SW1 to 11SW4 and the head (especially the ears) of the listener 4 are set to about 20 cm when the listener 4 is sitting on the chair 20.

In this example, audio signals of the channels are supplied to the speakers 11SW1 to 11SW4 from the audio signal output device 3 through signal lines (speaker cables).

As described above, according to the sound reproducing system of this embodiment in which the multi-channel speakers are attached to the chair 20 illustrated in FIG. 5, the listener 4 sitting on the chair 20 can enjoy realistic multi-channel sound with a large volume by using speakers, the number thereof being smaller than the number of channels. Also, sound leakage to the outside can be significantly reduced.

Particularly, in this embodiment, the speakers 11SW1 and 11SW2 serving as a sub-woofer are not accommodated in boxes and are placed near the ears of the listener 4, so that leakage of deep bass sound to adjoining rooms can be significantly reduced. Also, as described above, the sound of the rear-left and rear-right channels other than the channels for the sub-woofer are emitted from the speakers 11SW1 and 11SW2 after the virtual sound source process is performed thereon. Since the level of the audio signals can be lowered, the level of leakage of sound as well as bass sound can be further lowered. Accordingly, the listener can enjoy DVD viewing and so on with a sufficient volume without concern for others even at midnight.

Since the speakers 11SW1 and 11SW2 are placed near the ears of the listener, the output power of audio signals can be reduced to one hundredth of the conventional example in an extreme case. Accordingly, energy can be saved and the cost of the hardware (output amplifier) can be significantly reduced. Furthermore, since a small output power of audio signals is sufficient, thin, light, and inexpensive speakers that do not require large vibration amplitude can be used advantageously. Also, the small output power of audio signals enables reduction in heat generation and miniaturization of devices, such as a power supply. Accordingly, the sound reproducing system can be driven by batteries and can be embedded in a design of a chair or the like.

Therefore, energy saving can be realized in the entire sound reproducing system. In this sound reproducing system, the satisfaction level of the listener can be maintained and leakage of sound to neighborhood can be reduced.

Even in a typical soundproof window capable of attenuating sound by 45 dB at 5 KHz, the amount of attenuation decreases: 36 dB at 1 KHz and 20 dB at 100 Hz. Particularly, at 50 Hz or lower, the amount of attenuation is further smaller. In view of these circumstances, the soundproof effect of the sub-woofer according to this embodiment is significant. Compared to a soundproof remodeling of a room for enjoying video/sound reproducing, the cost saving effect is dramatic.

The audio signal output device 3 can be provided at a predetermined position, e.g., under the seating face of the chair 20. In that case, the audio signal output device 3 may receive audio signals Au from the DVD player 2, serving as a source of multi-channel audio signals, through a signal cable. In this configuration, however, the DVD player 2 needs to be connected to the chair via a signal cable. By providing a transmitting unit to transmit multi-channel audio signals wirelessly through radio waves or light in the DVD player 2 and by providing a receiving unit to receive the multi-channel audio signals that are wirelessly transmitted in the audio signal output device 3, the signal cable between the DVD player 2 and the chair 20 becomes unnecessary.

When audio signals from the source of multi-channel audio signals, such as the DVD player 2, are transmitted through radio waves or light, the DVD player 2 and the sound reproducing system can be wirelessly connected, so that the chair 20 provided with the sound reproducing system can be freely moved.

Figure 7:
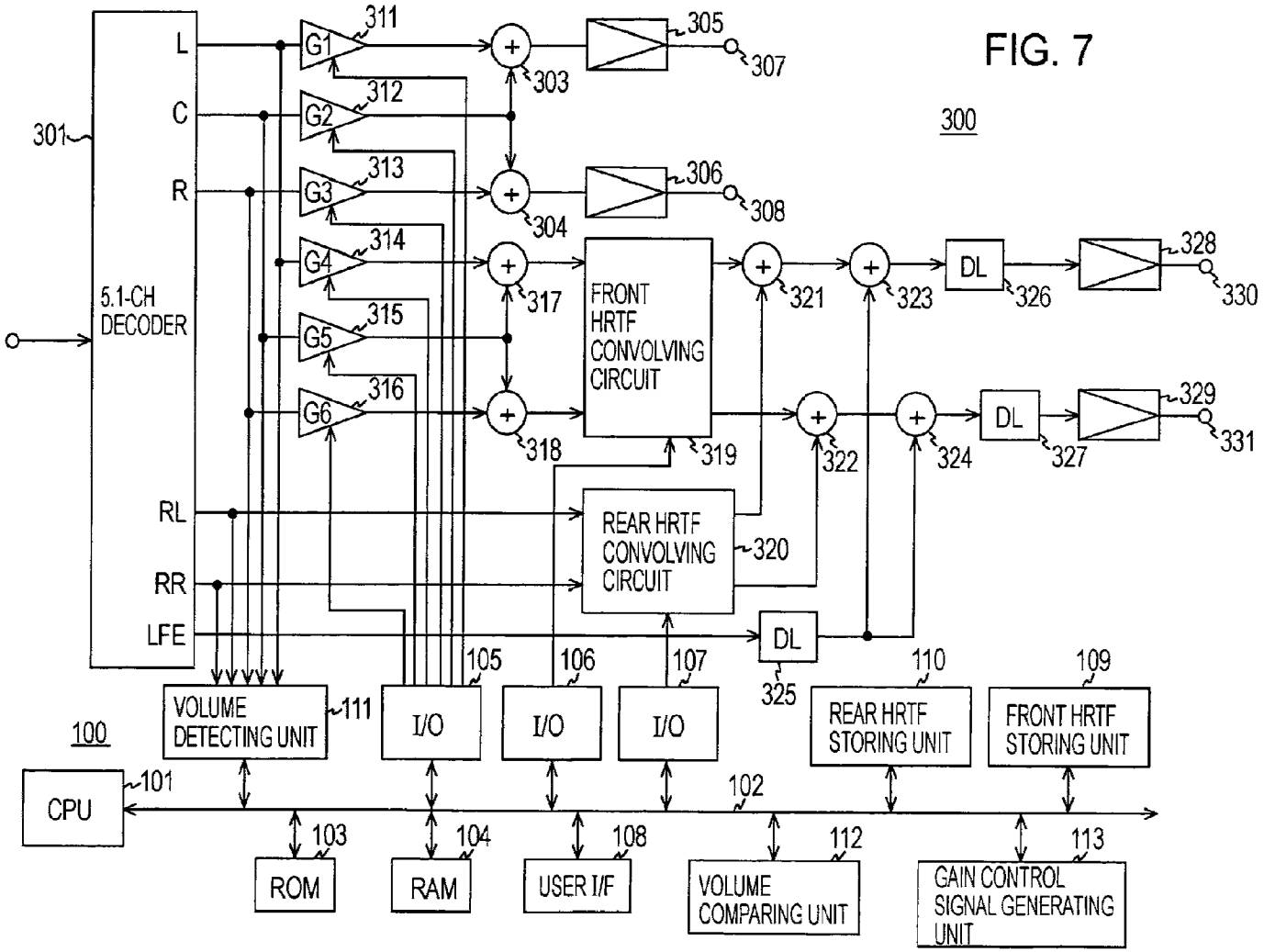
FIG. 7 is a block diagram of an example of a configuration of an audio signal output device in the sound reproducing system according to the embodiment.

Example of Configuration of the Audio Signal Output Device 3 According to the Embodiment FIG. 7 is a block diagram of an example of the configuration of the audio signal output device 3 according to this embodiment. The audio signal output device 3 according to this embodiment includes an audio signal processing unit 300 and a control unit 100 including a microcomputer.

The control unit 100 includes a CPU (central processing unit) 101, connected through a system bus 102 to a ROM (read only memory) 103 storing a software program, a RAM (random access memory) 104 serving as a work area, a plurality of input/output ports 105 to 107, a user operation interface 108, a front HRTF (head-related transfer function) storing unit 109, a rear HRTF storing unit 110, a volume detecting unit 111, a volume comparing unit 112, and a gain control signal generating unit 113. The user operation interface 108 includes a key operation unit that is directly provided in the audio signal output device 3, a remote commander, and a remote control signal receiving unit.

As described above, in this embodiment, audio signals Au transmitted from the DVD player 2 are supplied to a 5.1-channel decoder 301 in the audio signal output device 3. The 5.1-channel decoder 301 receives the audio signals Au, performs a channel decoding process thereon, and outputs audio signals L and R of the front-left and front-right channels, an audio signal C of the center channel, audio signals RL and RR of the rear-left and rear-right channels, and a low-frequency audio signal LFE.

The audio signal L of the front-left channel from the 5.1-channel decoder 301 is supplied to an adder 303 via a gain adjusting amplifier 311. The audio signal R of the front-right channel from the 5.1-channel decoder 301 is supplied to an adder 304 via a gain adjusting amplifier 313. The audio signal C of the center channel from the 5.1-channel decoder 301 is supplied to the adders 303 and 304 in equal amounts via a gain adjusting amplifier 312.

The adder 303 adds the audio signal L of the front-left channel from the gain adjusting amplifier 311 to the audio signal C of the center channel from the gain adjusting amplifier 312, and a sum audio signal L+C generated through the addition is led to an audio output terminal 307 via an amplifier 305. The audio signal supplied to the output terminal 307 is supplied to the speaker 11FL of the television receiver 1.

The adder 304 adds the audio signal R of the front-right channel from the gain adjusting amplifier 313 to the audio signal C of the center channel from the gain adjusting amplifier 312, and a sum audio signal R+C generated through the addition is led to an audio output terminal 308 via an amplifier 306. The audio signal supplied to the output terminal 308 is supplied to the speaker 11FR of the television receiver 1.

Also, the audio signal L of the front-left channel from the 5.1-channel decoder 301 is supplied to an adder 317 via a gain adjusting amplifier 314. The audio signal R of the front-right channel from the 5.1-channel decoder 301 is supplied to an adder 318 via a gain adjusting amplifier 316. The audio signal C of the center channel from the 5.1-channel decoder 301 is supplied to the adders 317 and 318 in equal amounts via a gain adjusting amplifier 315.

The adder 317 adds the audio signal L of the front-left channel from the gain adjusting amplifier 314 to the audio signal C of the center channel from the gain adjusting amplifier 315, and a sum audio signal L+C generated through the addition is supplied to a front HRTF convolving circuit 319.

The adder 318 adds the audio signal R of the front-right channel from the gain adjusting amplifier 316 to the audio signal C of the center channel from the gain adjusting amplifier 315, and a sum audio signal R+C generated through the addition is supplied to the front HRTF convolving circuit 319.

The front HRTF convolving circuit 319 convolves a front HRTF prepared in the front HRTF storing unit 109 to the audio signals L and R of the front-left and front-right channels from the 5.1-channel decoder 301 by using a digital filter or the like.

Accordingly, in the front HRTF convolving circuit 319, an audio signal input thereto is converted to a digital signal if the audio signal is not a digital signal, the front HRTF is convolved thereto, and the digital signal is converted to an analog signal, which is then output.

The audio signals RL and RR of the rear-left and rear-right channels obtained through decoding in the 5.1-channel decoder 301 are supplied to a rear HRTF convolving circuit 320 serving as a virtual sound source processing unit.

The rear HRTF convolving circuit 320 has the same configuration as that of the front HRTF convolving circuit 319. For example, the rear HRTF convolving circuit 320 convolves a rear HRTF prepared in the rear HRTF storing unit 110 to the audio signals RL and RR of the rear-left and rear-right channels from the 5.1-channel decoder 301 by using a digital filter or the like.

Accordingly, in the rear HRTF convolving circuit 320, an audio signal input thereto is converted to a digital signal if the audio signal is not a digital signal, the rear HRTF is convolved thereto, and the digital signal is converted to an analog signal, which is then output.

Figure 8:
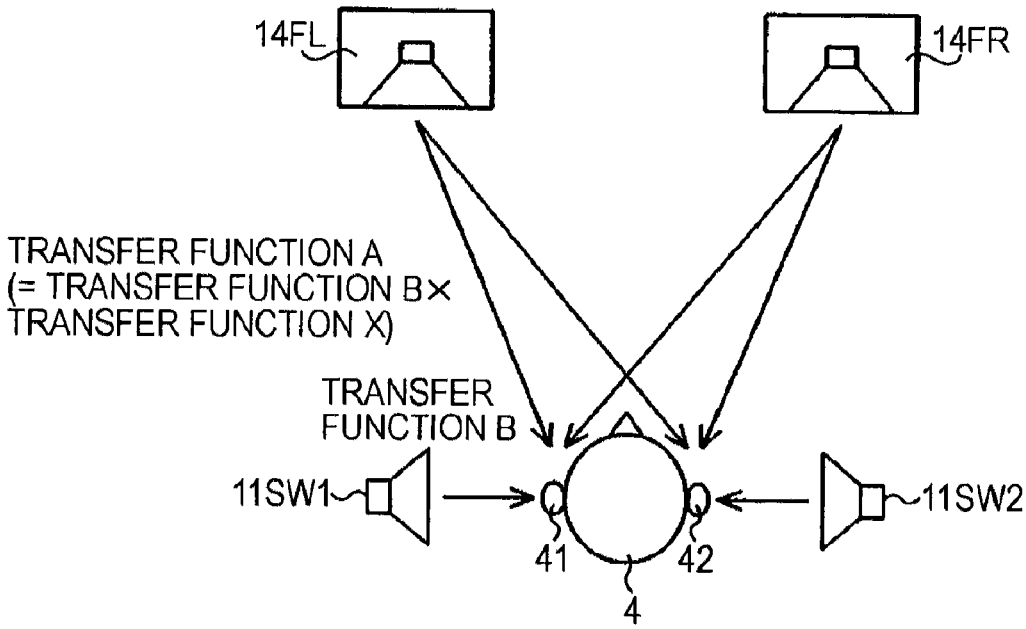
FIG. 8 is for illustrating a configuration of part of the blocks illustrated in FIG. 7.
Figure 9:
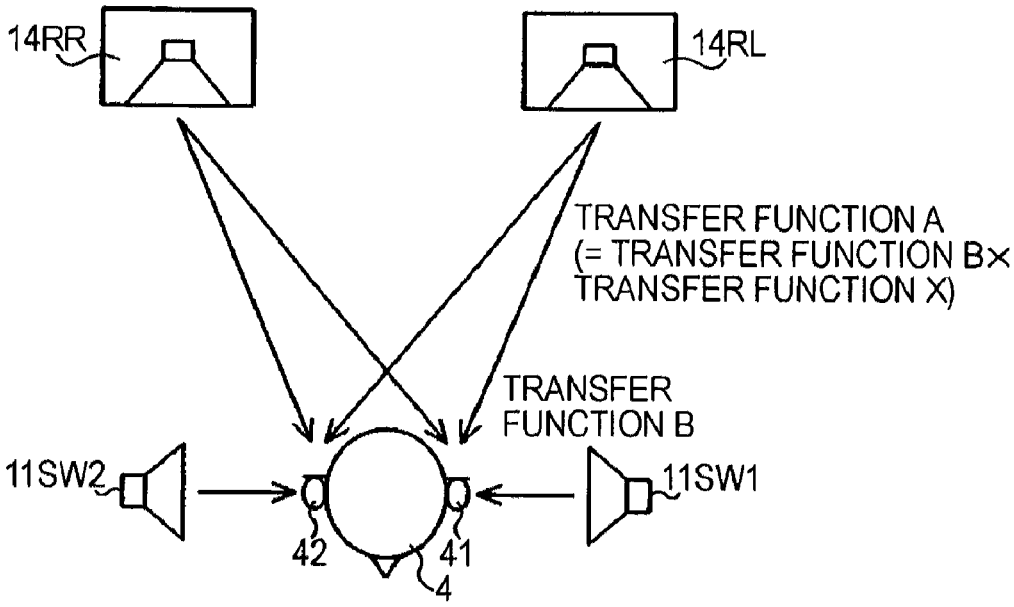
FIG. 9 is for illustrating a configuration of part of the blocks illustrated in FIG. 7.

The front HRTF and rear HRTF are obtained through measurement in the manner described below and are stored in the front HRTF storing unit 109 and the rear HRTF storing unit 110, respectively. FIGS. 8 and 9 are for illustrating a method for measuring the front HRTF and rear HRTF.

That is, as illustrated in FIG. 8, a left channel measuring microphone 41 and a right channel measuring microphone 42 are set near the ears of the listener 4. Then, a speaker 14FL for a front-left channel and a speaker 14FR for a front-right channel are placed at the positions where those speakers are to be typically placed (desired positions where the sound image is localized) in front of the listener 4.

Then, the sound emitted from the speaker 14FL when impulse is reproduced is collected by the microphones 41 and 42. On the basis of audio signals of the collected sound, a transfer function from the speaker 14FL to the ears (front HRTF about the front-left channel) is measured.

Likewise, the sound emitted from the speaker 14FR when impulse is reproduced is collected by the microphones 41 and 42. On the basis of audio signals of the collected sound, a transfer function from the speaker 14FR to the ears (front HRTF about the front-right channel) is measured.

The front HRTF is obtained in the following manner. That is, a transfer function from each speaker to the ears is measured under a condition where the front speakers FL and FR are placed on the left and right in front of the listener 4 at an angle of 30° and a distance of 2 meters from the listener 4. The transfer function obtained through the measurement is used as the front HRTF.

Also, as illustrated in FIG. 9, a speaker 14RL for a rear-left channel and a speaker 14RR for a rear-right channel are placed at the positions where those speakers are to be typically placed (desired positions where the sound image is localized) at the rear of the listener 4.

Then, the sound emitted from the speaker 14RL when impulse is reproduced is collected by the microphones 41 and 42. On the basis of audio signals of the collected sound, a transfer function from the speaker 14RL to the ears (rear HRTF about the rear-left channel) is measured.

Likewise, the sound emitted from the speaker 14RR when impulse is reproduced is collected by the microphones 41 and 42. On the basis of audio signals of the collected sound, a transfer function from the speaker 14RR to the ears (rear HRTF about the rear-right channel) is measured.

The rear HRTF is obtained in the following manner. That is, a transfer function from each speaker to the ears is measured under a condition where the rear speakers RL and RR are placed on the left and right at the rear of the listener 4 at an angle of 30° and a distance of 2 meters from the listener 4. The transfer function obtained through the measurement is used as the rear HRTF.

The transfer function (HRTF) is further described. For example, the transfer function from the front-left side to the left ear in FIG. 8 is called transfer function A. Then, the transfer function from the speaker 11SW1 near the left ear to the microphone 41 is measured, and the obtained transfer function is called transfer function B. Then, transfer function X is calculated so that an expression transfer function B×transfer function X=transfer function A is satisfied. The obtained transfer function X is convolved to audio signals to be supplied to the speaker 11SW1. Accordingly, the sound emitted at that time from the speaker 11SW1 is felt by the listener 4 as if the sound was emitted at a position two meters away on the front-left side. This is the same for the rear HRTF illustrated in FIG. 9.

Transfer function X is not always necessary, but only transfer function A may be used in some cases. In the description made above, a single transfer function is described as an representative. Actually, however, a plurality of transfer functions exist as illustrated in FIGS. 8 and 9.

The front HRTF and rear HRTF measured in the above-described manner are stored in the front HRTF storing unit 109 and the rear HRTF storing unit 110, respectively, and are supplied to the front HRTF convolving circuit 319 and the rear HRTF convolving circuit 320 via the input/output ports 106 and 107 so as to be convolved therein.

Accordingly, when sound is reproduced by supplying audio signals FL* and FR* from the front HRTF convolving circuit 319 to the speakers 11SW1 and 11SW2 placed near the ears, the listener 4 listens to the reproduced sound while feeling as if the sound was emitted from the front-left speaker 11FL' and front-right speaker 11FR' indicated by broken lines in FIG. 2.

On the other hand, when sound is reproduced by supplying audio signals RL* and RR* from the rear HRTF convolving circuit 320 to the speakers 11SW1 and 11SW2 placed near the ears, the listener 4 listens to the reproduced sound while feeling as if the sound was emitted from the rear-left speaker 11RL and rear-right speaker 11RR indicated by broken lines in FIG. 2.

At this time, the levels of the front audio signals FL* and FR* and the audio signals RL* and RR* of the rear-left and rear-right channels on which the virtual sound source process is performed may be lower than those of the signals supplied to the real speakers: the speakers 11FL', 11FR', 11RL, and 11RR. This is because the speakers 11SW1 and 11SW2 are placed near the ears of the listener 4.

In this specification, the above-described process is called a virtual sound source process because the listener listens to sound while feeling as if the sound was emitted from virtual speaker positions due to the above-described convolution of HRTF.

In the above-described manner, the audio signals FL* and FR* obtained through the virtual sound source process in the front HRTF convolving circuit 319 are supplied to adders 321 and 322. Also, the audio signals RL* and RR* obtained through the virtual sound source process in the rear HRTF convolving circuit 320 are supplied to the adders 321 and 322 and are added to the audio signals FL* and FR* supplied from the front HRTF convolving circuit 319.

Then, an output of the addition in the adder 321 is supplied to an adder 323, whereas an output of the addition in the adder 322 is supplied to an adder 324.

The adders 323 and 324 are supplied with a low-frequency audio signal LFE from the 5.1-channel decoder 301 via a delay unit 325. The low-frequency audio signal LFE is added to the output from the adder 321 and the output from the adder 322. Outputs of addition from the adders 323 and 324 are output via delay units 326 and 327.

The amounts of delay in the delay units 326 and 327 are used for adjusting the time until when the reproduced sound from the speakers 11FL and 11FR for the front-left and front-right channels placed as real speakers reaches the ears of the listener 4 and the time until when the reproduced sound from the speakers 11SW1 and 11SW2 reaches the ears of the listener 4.

The amount of delay in the delay unit 325 is used for preventing deterioration of the sound image localization of the front-left and front-right channels if the sound of the LFE channel includes the sound of the front channels.

That is, since the speakers on the front side are often small, a low-frequency component in the sound of the front-left and front-right channels is often mixed to the sound of the LFE channel. The speakers 11SW1 and 11SW2 are placed near the ears of the listener 4, and the sound output therefrom reaches the ears faster than that output from the speakers on the front side. Therefore, if sound is simultaneously output from the real speakers provided on the front side of the listener 4 and the speakers 11SW1 and 11SW2 near the ears of the listener 4, the sound image localization of the front-left and front-right channels may deteriorate.

In order to prevent such deterioration, the amounts of delay in the delay units 325, 326, and 327 are adjusted so that no delay occurs in the arrival time in the ears of both the sound from the real speakers on the front side and the sound from the speakers 11SW1 and 11SW2 near the ears, specifically that the time from when the reproduced sound is output from the speakers 11FL and 11FR for the front-left and front-right channels until when the sound reaches the ears of the listener 4 matches the time from when the reproduced sound is output from the speakers 11SW1 and 11SW2 until when the sound reaches the ears of the listener 4.

In this embodiment, in order to further stabilize the localization of the center channel, the amounts of delay in the delay units 325, 326, and 327 are adjusted so that the reproduced sound from the speakers 11FL and 11FR for the front channels reaches the ears of the listener 4 faster and that the audio signals FL*, FR*, RL*, and RR* obtained through the virtual sound source process and the audio signals of the LFE channel delay. In this method, the listener 4 can feel as if he/she listens to only the sound emitted from the speakers 11FL and 11FR as the sound of the front channels due to the Haas effect.

The audio signals generated through addition in the adders 323 and 324 are led to audio output terminals 330 and 331 through amplifiers 328 and 329.

These audio output terminals 330 and 331 connect to the speakers 11SW1 and 11SW2 placed near the ears of the listener 4. Thus, the speakers 11SW1 and 11SW2 function as a sub-woofer to reproduce sound based on low-frequency audio signals LFE and also reproduce sound based on audio signals of the 5.1 channel on which the virtual sound source process is performed.

Improvement of Sound Image Localization of Center Channel

In this embodiment, reproducing of sound by the real speakers and reproducing of sound by audio signals on which the virtual sound source process is performed are used in parallel for audio signals of the center channel, and the gains of the gain adjusting amplifiers 311 to 316 are adjusted, so as to improve the sound image localization of the center channel.

Gain control signals of the gain adjusting amplifiers 311 to 316 are generated in the following manner by using the volume detecting unit 111, the volume comparing unit 112, and the gain control signal generating unit 113 of the control unit 100.

In this embodiment, among audio signals of the 5.1 channel output from the 5.1-channel decoder 301, audio signals except those of the LFE channel are supplied to the volume detecting unit 111.

The volume detecting unit 111 performs full-wave rectification on audio signals of the respective channels supplied thereto and detects the volumes (audio signal levels) of the respective channels. Then, the volume detecting unit 111 outputs the detected volumes to the system bus 102.

The CPU 101 of the control unit 100 transfers information of the volumes of the respective channels obtained from the volume detecting unit 111 to the volume comparing unit 112.

The volume comparing unit 112 compares the volumes of the respective channels, focuses attention on the audio signal levels of the front-left and front-right channels, the audio signal level of the center channel, and the audio signal levels of the rear-left and rear-right channels, and detects that the volumes are evenly distributed, that the volume of only the center channel is large, that a volume ratio is higher in the front side than in the rear side, or that the volume concentrates on one of the front channels.

Particularly, in this embodiment, the volume comparing unit 112 compares the volume of the center channel with each of the volumes of the other channels (except the LFE channel) and transmits a comparison detection output to the system bus 102. That is, in this embodiment, the volume comparing unit 112 transmits a relative volume detection output of the center channel with respect to each of the other channels as the comparison detection output.

The CPU 101 of the control unit 100 transfers the comparison detection output from the volume comparing unit 112 to the gain control signal generating unit 113.

In this embodiment, the gain control signal generating unit 113 generates gain control signals to adjust the gains of the gain adjusting amplifiers 311 to 316 so that a desired sound image localization of the center channel can be obtained.

Then, the gain control signal generating unit 113 transmits the generated gain control signals for the gain adjusting amplifiers 311 to 316 to the system bus 102. The CPU 101 of the control unit 100 supplies the respective gain control signals to the respective gain adjusting amplifiers 311 to 316 via the input/output port 105.

In the above-described configuration, the volume detecting unit 111, the volume comparing unit 112, and the gain control signal generating unit 113 may be realized by a hardware configuration or may be realized by software processing executed by the CPU 101 in accordance with a program stored in the ROM 103 in the control unit 100.

Example of Gain Control

In this embodiment, when the volume of the center channel is larger by far than each of the volumes of the other channels, control is performed to increase the volume of the sound of the center channel in the audio signals to be supplied to the real speakers provided in front of the listener 4. Also, the volume of the sound of the center channel in the audio signals on which the virtual sound source process is performed to be supplied to the two speakers 11SW1 and 11SW2 provided near the ears of the listener 4 is decreased, or the sound of the center channel is removed from the audio signals on which the virtual sound source process is performed.

That is, when the volume of the center channel is larger by far than each of the volumes of the other channels, the gain control signal generating unit 113 at least increases the gain of the gain adjusting amplifier 312 and decreases the gain of the gain adjusting amplifier 315. The gains of the gain adjusting amplifiers 311, 313, 314, and 316 are kept at preset normal gains.

When the volume of the center channel is larger not by far than each of the volumes of the other channels but is relatively the largest, the volume of the sound of the center channel in the audio signals on which the virtual sound source process is performed to be supplied to the two speakers 11SW1 and 11SW2 provided near the ears of the listener 4 is decreased to be smaller than the volume of the sound of the center channel in the audio signals to be supplied to the real speakers provided in front of the listener 4.

That is, when the volume of the center channel is relatively the largest among the volumes of the other channels, the gain control signal generating unit 113 decreases the gains of the gain adjusting amplifiers 311, 313, and 315 and keeps the gains of the gain adjusting amplifiers 312, 314, and 316 at normal gains.

When signals exist only in the center channel regardless of the volume, that is, when the volumes of the channels other than the center channel (except the LFE channel) are very small or zero, control is performed so as to assign all volumes of sound components of the center channel in the audio signals that are reproduced by the real speakers provided in front of the listener 4, and the sound of the center channel in the audio signals on which the virtual sound source process is performed to be supplied to the two speakers 11SW1 and 11SW2 provided near the ears of the listener 4 is removed. In this case, the sound of the center channel in the audio signals on which the virtual sound source process is performed may be decreased, but it is more effective to remove the sound of the center channel.

That is, in this case, the gain control signal generating unit 113 sets the gain of the gain adjusting amplifier 312 to a normal gain or increases the gain, and sets the gain of the gain adjusting amplifier 314 to zero or decreases the gain. The gains of the other gain adjusting amplifiers are set to normal gains.

As can be understood from the above description, basically, in this embodiment, when the volume of the center channel is larger than each of the volumes of the other channels, a larger portion of the volume of the sound of the center channel is preferentially assigned to the real speakers provided in front of the listener 4, and a smaller portion of the volume of the sound of the center channel is assigned to the two speakers 11SW1 and 11SW2 provided near the ears of the listener 4.

Also, when it is difficult to determine which of the volume of the center channel and the volume of any of the other channels is dominant, the volume of all sound components of the center channel is assigned to the real speakers provided in front of the listener 4, and the audio signals of the center channel are removed from the audio signals to be supplied to the two speakers 11SW1 and 11SW2 provided near the ears of the listener 4. In this case, too, the sound of the center channel in the audio signals on which the virtual sound source process is performed may be decreased, but it is more effective to remove the audio signals.

When it is difficult to determine which of the volume of the center channel and the volume of any of the other channels is dominant, sound is reproduced not only by the real speakers as described above, but the sound is reproduced by the real speakers and by the audio signals on which the virtual sound source process is performed. Also, the audio signals to be supplied to the speakers 11SW1 and 11SW2 near the ears of the listener 4 may be delayed so that the arrival time thereof in the ears is later than that of the sound emitted from the real speakers on the front side.

By causing such delay, only the sound components that are reproduced by the real speakers on the front side are dominant among the sound components of the center channel due to the above-described Haas effect, and the sound components of the center channel that are emitted from the speakers 11SW1 and 11SW2 near the ears of the listener 4 do not affect the sound image localization. Accordingly, a favorable sound image localization of the center channel can be obtained.

FIGS. 10A, 10B, and 10C illustrate the relationship in volume among the front-left and front-right channels, the center channel, and the rear-left and rear-right channels. With reference to these figures, description is given below about an example of volume balance between the reproduced sound from the real speakers on the front side and the reproduced sound from the two speakers 11SW1 and 11SW2 near the ears of the listener 4 using the audio signals on which the virtual sound source process is performed, for realizing a favorable sound image localization of the center channel in a case where the volume is classified to large (l), middle (m), and small (s) and a plurality of sets thereof are assumed.

FIG. 10A illustrates the relationship in volume that can be held as a source (source signal) among the front-left and front-right channels, the center channel, and the rear-left and rear-right channels. That is, FIG. 10A illustrates the sets of volumes, which can be classified into large (l), middle (m), and small (s). As illustrated in FIG. 10A, 27 cases from case No. 1 to case No. 27 are possible.

FIG. 10B illustrates a desired volume of the sound of the center channel to be emitted from the real speakers in each of cases No. 1 to No. 27. A blank cell indicates that the volume of the sound of the center channel from the real speakers is zero. As described above, the gain of the volume may be decreased instead of setting the volume to zero.

FIG. 10C illustrates the types of signals to be supplied to the two speakers 11SW1 and 11SW2 placed near the ears of the listener 4 and a desired volume thereof in cases No. 1 to No. 27. That is, "full at the ears" in FIG. 10C indicates that the virtual sound source process is performed on the audio signals of all channels except the LFE channel among the audio signals to be supplied to the two speakers 11SW1 and 11SW2. "Without C at the ears" indicates that the audio signals C of the center channel are removed as well as the audio signals of the LFE channel from the audio signals to be supplied to the two speakers 11SW1 and 11SW2 and that the virtual sound source process is performed on the audio signals of the other channels.

Referring to FIG. 10A, in cases Nos. 4, 5, 7 to 9, 13, 14, 16 to 18, and 25 to 27 where the cells are shaded in the center channel, the volume of the sound of the center channel is relatively larger than the volume of the other channels.

In those cases Nos. 4, 5, 7 to 9, 13, 14, 16 to 18, and 25 to 27, it is preferable that the sound of the center channel is reproduced mainly by the real speakers, as illustrated in FIG. 10B. Also, it is preferable that the audio signals to be supplied to the two speakers 11SW1 and 11SW2 placed near the ears of the listener 4 are set to "without C at the ears".

Under consideration of the above-described points, in this embodiment, in those cases Nos. 4, 5, 7 to 9, 13, 14, 16 to 18, and 25 to 27, the gain control signal generating unit 113 generates such gain control signals for the gain adjusting amplifiers 312, 314, and 316 that the gains G2, G4, and G6 are set to preset normal gains, and generates such gain control signals for the gain adjusting amplifiers 311, 313, and 315 that the gains G1, G3, and G5 are set to zero. These gain control signals are supplied to the gain adjusting amplifiers 311 to 316, respectively, via the input/output port 105.

As described above, in the example illustrated in FIGS. 10A to 10C, when the volume of the sound of the center channel, in which the virtual sound image is difficult to be localized, is relatively the largest, the virtual sound source process is not performed on the sound of the center channel, but the sound of the center channel is reproduced and output mainly from the real speakers placed on the front side. Accordingly, the reproducing sound image localization of the center channel is improved.

In this embodiment, referring to FIG. 10A, in cases Nos. 1 to 3, 6, 10 to 12, 15, and 19 to 24 where the volume of the center channel is not particularly larger than the volume of the other channels, it is preferable that the sound of the center channel is not reproduced in the real speakers but that the audio signals of "full at the ears" on which the virtual sound source process is performed are supplied to the two speakers 11SW1 and 11SW2 placed near the ears of the listener 4, as illustrated in FIGS. 10B and 10C.

Therefore, in this embodiment, in those cases Nos. 1 to 3, 6, 10 to 12, 15, and 19 to 24, the gain control signal generating unit 113 generates such gain control signals for the gain adjusting amplifiers 311, 312, and 313 that the gains G1, G2, and G3 are set to zero, and generates such gain control signals for the gain adjusting amplifiers 314, 315, and 316 that the gains G4, G5, and G6 are set to normal gains. These gain control signals are supplied to the gain adjusting amplifiers 311 to 316, respectively, via the input/output port 105.

Therefore, in those cases Nos. 1 to 3, 6, 10 to 12, 15, and 19 to 24, all audio signals of the 5.1 channel are reproduced only in the two speakers 11SW1 and 11SW2 placed near the ears of the listener 4. The volume of the sound of the center channel is equivalent to or smaller than the volume of the other channels and is thus not felt unnatural even if the virtual sound image thereof is localized. In this case, the volume of the sound emitted from the real speakers on the front side is small or zero, and thus an advantage of low noise of the sound reproducing system according to this embodiment can be maintained.

Alternatively, in those cases Nos. 1 to 3, 6, 10 to 12, 15, and 19 to 24, the gains G1, G2, and G3 of the gain adjusting amplifiers 311, 312, and 313 may not be set to zero. For example, gain control signals to set the gains to normal or to decrease the gains may be generated, and reproducing of sound by the real speakers and reproducing of sound in virtual sound image localization by the speakers 11SW1 and 11SW2 may be used together. In that case, the audio signals to be supplied to the speakers 11SW1 and 11SW2 are delayed so that the audio signals are reproduced at timing later than that of reproducing by the real speakers in order to improve the sound image localization of the center channel to the front by using the above-described Haas effect.

Another Embodiment and Modification

In the example illustrated in FIGS. 10A to 10C, the audio signals on which the virtual sound source process is performed to be supplied to the speakers 11SW1 and 11SW2 placed near the ears of the listener 4 include signals of "full at the ears" including the center channel and signals of "without C at the ears" not including the center channel. In this case, the virtual sound source process is performed or not performed on the audio signals of the center channel depending on cases, which is complicated.

As a gain control method not requiring removal or addition of the center channel, the following simple method can be used. That is, reproducing of sound by the real speakers provided in front of the listener 4 and reproducing of sound of virtual sound image localization by the speakers 11SW1 and 11SW2 are used together. Also, gain control is performed to increase the volume of the audio signals of the channel to be supplied to the real speakers on the front side.

In this simple method, too, it is more preferable that the audio signals to be supplied to the speakers 11SW1 and 11SW2 are delayed so that the audio signals are reproduced at timing later than that of reproducing the sound by the real speakers on the front side in order to improve the sound image localization of the center channel by the real speakers to the front side by using the above-described Haas effect.

In the above-described embodiment, the speakers 11FL and 11FR included in the television receiver 1 are used as the real speakers provided on the front side of the listener 4. Alternatively, independent speakers may be provided separately from the television receiver 1. For example, as illustrated in FIG. 11, speakers 51FL and 51FR for the front-left and front-right channels may be attached to the above-described chair 20.

Figure 11:
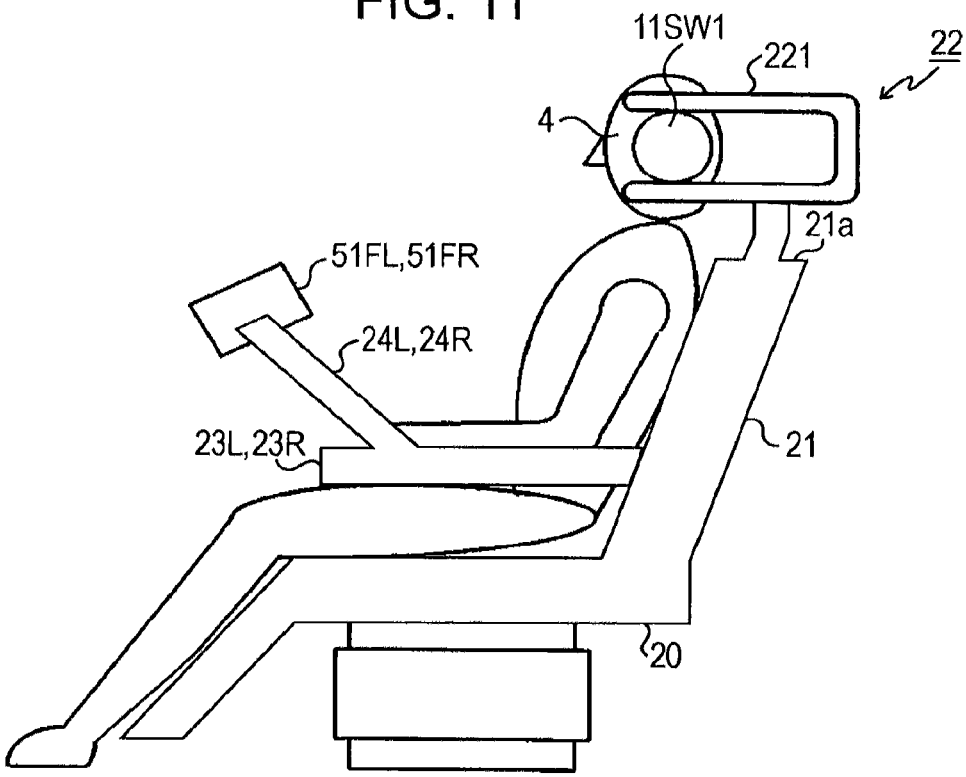
FIG. 11 illustrates an example of placement of speakers in the sound reproducing system according to the embodiment.

In the example illustrated in FIG. 11, holding arms 24L and 24R are attached to armrests 23L and 23R of the chair 20, and the speakers 51FL and 51FR in which speaker units are accommodated in speaker boxes are attached to the holding arms 24L and 24R.

In the above-described embodiment, the real speaker for the center channel is provided by supplying audio signals of the center channel to the two speakers for the front-left and front-right channels in equal amounts of 1:1. Of course, a real speaker for the center channel may be actually provided. In that case, only the real speaker for the center channel is provided as a real speaker and the real speakers for the front-left and front-right channels are unnecessary.

When a virtual sound image is to be localized by using audio signals on which the virtual sound source process is performed, at least two speakers are required to receive the audio signals on which the virtual sound source process is performed. Therefore, in the above-described embodiment, two real speakers and two speakers for virtual sound image localization, four speakers in total, are required. Also, in the above-described modification, the speaker for the center channel is used as a real speaker, and thus four speakers in total are required including the two speakers for virtual sound image localization.

If the two speakers for virtual sound image localization are used also for the front-left and front-right channels for the center channel, the number of necessary speakers can be reduced to two.

Figure 12:
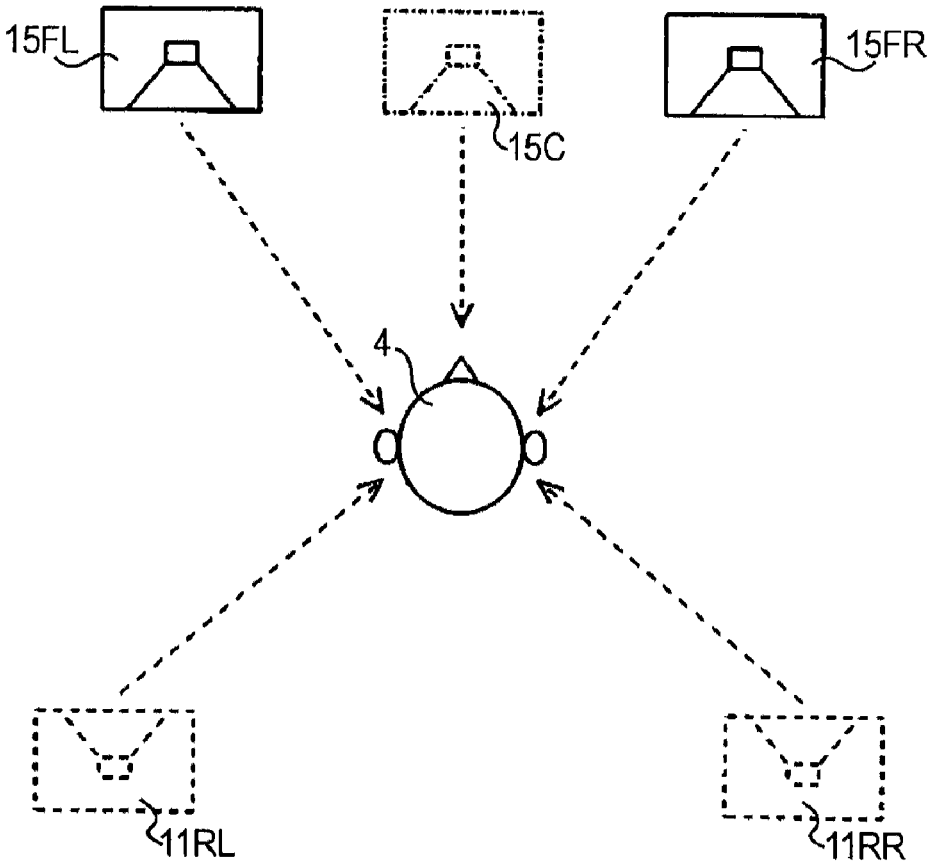
FIG. 12 illustrates an example of placement of speakers in the sound reproducing system according to another embodiment.
Figure 13:
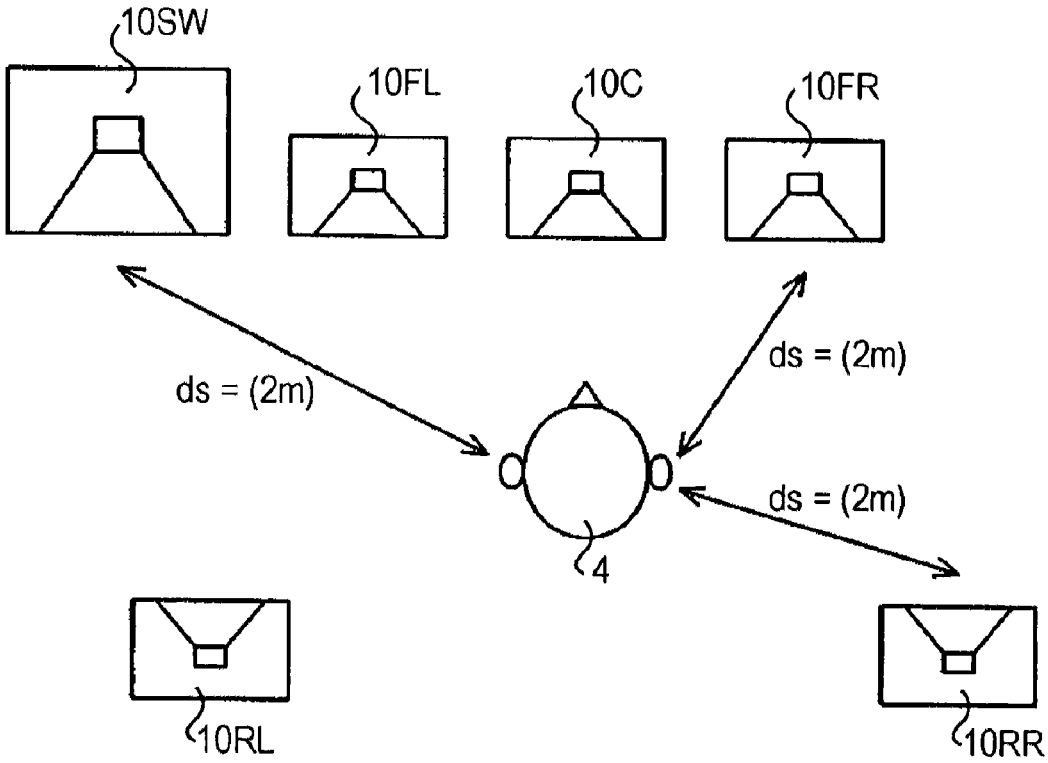
FIG. 13 illustrates a typical example of placement of speakers in a conventional sound reproducing system.

That is, the two speakers for virtual sound image localization need not be placed near the ears of the listener 4 unlike in the above-described embodiment. Thus, as illustrated in FIG. 12, two speakers 15FL and 15FR for virtual sound image localization are placed at the positions of the speakers for the front-left and front-right channels. Then, HRTF for the two speakers 15FL and 15FR is measured for front and rear sides, and audio signals on which the virtual sound source process is performed are supplied to the two speakers 15FL and 15FR.

Alternatively, the two speakers 15FL and 15FR for the front-left and front-right channels are regarded as real speakers and the audio signals of the center channel are supplied to the two speakers 15FL and 15FR in equal amounts of 1:1. In this method, as in the above-described embodiment, a real speaker 15C for the center channel can be realized as indicated by a dashed and dotted line in FIG. 12. Accordingly, the number of speakers provided can be reduced to two.

In this case, it is needless to say that the speakers for the rear-left and rear-right channels can be speakers for virtual sound image localization, as indicated by broken lines in FIG. 12. However, the LFE channel requires a real speaker. When multi-channel surround of the 5.1 channel is to be realized, a real speaker for the LFE channel is required, and thus the total number of speakers is three.

In the above-described embodiment, the center channel is regarded as a channel in which the sound image is localized in a plane including the median plane of the listener. However, the present invention is not limited to the center channel. For example, a channel directly behind the listener or a channel directly above the head of the listener may be used.

It should be understood by those skilled in the art that various modifications, combinations, sub-combinations and alterations may occur depending on design requirements and other factors insofar as they are within the scope of the appended claims or the equivalents thereof.

What is claimed is:

1. A sound reproducing system to reproduce audio signals of a plurality of channels including a first channel in which a reproduced sound image is localized in a position in a front direction of a listener, the sound reproducing system comprising:

a first speaker that is supplied with first audio signals of the first channel and that is placed so that a first reproduced sound image generated by the first audio signals of the first channel is localized in a position in the front direction of the listener;

a pair of second speakers that are supplied with second audio signals on which a virtual sound source process is performed so that a second reproduced sound image is localized in a predetermined position;

virtual sound source processing means for performing the virtual sound source process on the audio signals of the plurality of channels so as to generate the second audio signals to be supplied to the second speakers;

volume detecting means for detecting a volume of the first channel from the first audio signals of the first channel and detecting volumes of channels other than the first channel from other audio signals of the other channels;

volume comparing means for comparing the volume of the first channel with each of the volumes of the other channels detected by the volume detecting means; and control means for controlling the gains of the first audio signals of the first channel and the other channels based on a comparison result generated by the volume comparing means;

wherein the second speakers are held by holding means at predetermined positions near the ears of the listener, and wherein speaker units of the second speakers are not attached to a baffle plate so that sound components output from front and rear sides of vibrating plates of the speaker units can be added to each other.

2. The sound reproducing system according to claim 1, wherein, if it is determined that the volume of the first channel is relatively larger than each of the volumes of the other channels, the control means performs gain control to decrease the volume of the first audio signals of the first channel among the audio signals of the plurality of channels to be supplied to the virtual sound source processing means.

3. The sound reproducing system according to claim 1, wherein, if it is determined that the volume of the first channel is relatively larger than each of the volumes of the other channels, the control means performs control to remove the first audio signals of the first channel from the audio signals of the plurality of channels to be supplied to the virtual sound source processing means.

4. The sound reproducing system according to claim 1, wherein, if it is determined that the volume of the first channel is relatively larger than each of the volumes of the other channels, the control means controls the gain of the first audio signals of the first channel in order to increase the volume of the first channel.

5. The sound reproducing system according to claim 4, wherein, if it is determined that the volume of the first channel is relatively larger than each of the volumes of the other channels, the control means performs control so that the audio signals on which the virtual sound source process is performed are supplied to the second speakers while being delayed so that sound is emitted therefrom at timing later than sound emission timing in the first speaker.

6. The sound reproducing system according to claim 1, wherein, among the audio signals to be supplied to the second speakers after the virtual sound source process is performed thereon, at least the audio signals of the same channel as that of the audio signals to be supplied to the first speaker are delayed so that sound is emitted from the second speakers later than sound emission timing in the first speaker.

7. The sound reproducing system according to claim 1, wherein the audio signals of the plurality of channels are audio signals of a multi-channel surround method, and wherein the first audio signals of the first channel are audio signals of a center channel.

8. The sound reproducing system according to claim 7, wherein the first speaker includes two speakers for two front-left and front-right channels, and wherein the first audio signals of the center channel of the first channel are added to the audio signals of the front-left channel and the front-right channel, respectively.

9. A sound reproducing method in a sound reproducing system including:

a first speaker that is supplied with first audio signals of a first channel among audio signals of a plurality of channels including the first channel in which a reproduced sound image is localized in a position in a front direction of a listener and that is placed so that a first reproduced sound image generated by the first audio signals of the first channel is localized in a position in the front direction of the listener;

a pair of second speakers that are supplied with second audio signals on which a virtual sound source process is performed so that a second reproduced sound image is localized at a predetermined position;

wherein speaker units of the second speakers are not attached to baffle plate so that sound components output from front and rear sides of vibrating plates of the speaker units can be added to one another; and virtual sound source processing means for performing the virtual sound source process on the audio signals of the plurality of channels so as to generate the second audio signals to be supplied to the second speakers;

the sound reproducing method comprising the steps of:

comparing the volume of the first audio signals of the first channel to be supplied to the first speaker with each of the volumes of the other audio signals of the other channels, the comparison being performed by volume comparing means of the sound reproducing system; and controlling gains of the first audio signals of the first channel and the other channels based on a comparison result generated in the volume comparing step.

10. A sound reproducing apparatus comprising:

virtual sound source processing means that is supplied with audio signals of a plurality of channels including a first channel in which a reproduced sound image is localized in a position in a front direction of a listener and that performs a virtual sound source process on the audio signals of the plurality of channels so as to generate processed audio signals to be supplied to a pair of speakers;

wherein speaker units of the pair of speakers are not attached to a baffle plate so that sound components output from front and rear sides of vibrating plates of the speaker units can be added to one another;

an output circuit for outputting first audio signals of the first channel to a front speaker placed in the front direction of the listener;

volume detecting means for detecting a volume of the first channel from the first audio signals of the first channel and detecting volumes of channels other than the first channel from other audio signals of the other channels; and control means for controlling gains of the first audio signals of the first channel and the other channels based on a comparison result of the volume of the first channel and the volumes of the other channels detected by the volume detecting means.

11. A sound reproducing system to reproduce audio signals of a plurality of channels including a first channel in which a reproduced sound image is localized in a position in a front direction of a listener, the sound reproducing system comprising:

a first speaker that is supplied with first audio signals of the first channel and that is placed so that a first reproduced sound image generated by the first audio signals of the first channel is localized in a position in the front direction of the listener;

a pair of second speakers that are supplied with second audio signals on which a virtual sound source process is performed so that a second reproduced sound image is localized in a predetermined position;

wherein speaker units of the second speakers are not attached to baffle plate so that sound components output from front and rear sides of vibrating plates of the speaker units can be added to one another;

a virtual sound source processing unit configured to perform the virtual sound source process on the audio signals of the plurality of channels so as to generate second audio signals to be supplied to the second speakers;

a volume detecting unit configured to detect a volume of the first channel from the first audio signals of the first channel and detect volumes of channels other than the first channel from the audio signals of the other channels;

a volume comparing unit configured to compare the volume of the first channel with each of the volumes of the other channels detected by the volume detecting unit; and a control unit configured to control gains of the audio signals of the first channel and the other channels based on a comparison result generated by the volume comparing unit.

12. A sound reproducing apparatus comprising:

a virtual sound source processing unit that is supplied with audio signals of a plurality of channels including a first channel in which a reproduced sound image is localized in a position in a front direction of a listener and that performs a virtual sound source process on the audio signals of the plurality of channels so as to generate processed audio signals to be supplied to a pair of speakers;

wherein speaker units of the pair of speakers are not attached to a baffle plate so that sound components output from front and rear sides of vibrating plates of the speaker units can be added to one another;

an output circuit configured to output first audio signals of the first channel to a front speaker placed in the front direction of the listener;

a volume detecting unit configured to detect a volume of the first channel from the first audio signals of the first channel and detect volumes of the channels other than the first channel from other audio signals of the other channels; and a control unit configured to control gains of the audio signals of the first channel and the other channels based on a comparison result of the volume of the first channel and the volumes of the other channels detected by the volume detecting unit.

* * * * *